US006295676B1

(12) United States Patent
Warner

(10) Patent No.: US 6,295,676 B1
(45) Date of Patent: Oct. 2, 2001

(54) MATTRESS CONSTRUCTION

(76) Inventor: Bradley Warner, 83 Bakersfield Street, Downsview Ontario (CA), M3J 1Z4

( * ) Notice: Subject to any disclaimer, the term of this patent is extended or adjusted under 35 U.S.C. 154(b) by 0 days.

(21) Appl. No.: 09/548,747

(22) Filed: Apr. 13, 2000

Related U.S. Application Data

(63) Continuation-in-part of application No. 09/061,130, filed on Apr. 16, 1998, now abandoned.

(51) Int. Cl.[7] ..... A47C 23/053
(52) U.S. Cl. ..... 5/720; 5/717; 5/716
(58) Field of Search ..... 5/720, 717, 716, 5/655.7, 655.8, 257, 239, 246; 267/80, 91, 81, 84

(56) References Cited

U.S. PATENT DOCUMENTS 4,462,129 * 7/1984 Brannock ..... 5/717
4,523,344 * 6/1985 Stumpf et al. ..... 5/720
5,987,678 * 11/1999 Ayers ..... 5/720
6,158,071 * 12/2000 Wells ..... 5/717

* cited by examiner

*Primary Examiner*—Lynne H. Browne
*Assistant Examiner*—Fredrick Conley

(57) ABSTRACT

A mattress has a main sleep area surrounded by a perimeter trim. Both the main sleep area and the perimeter trim are formed from wire springs contained within pockets of soft material. The wire springs in the sleep area are arranged in honeycomb nested rows. The wire springs of the perimeter trim, which are of different wire construction with different flex characteristic from the wire springs in the main sleep area, are arranged in side by side rows which are not honeycomb nested. In addition, the wire springs of the perimeter trim are pivotally linked directly to one another across the perimeter trim, both widthwise and lengthwise of the mattress which produces an essentially non-feelable flex transition between the perimeter trim and the main sleep area of the mattress.

6 Claims, 8 Drawing Sheets

MATTRESS CONSTRUCTION

This application is a CI-P of Ser. No. 09/061,130 filed Apr. 16, 1998, abandoned.

FIELD OF THE INVENTION

The present invention relates to a mattress formed from pocketed wire springs.

BACKGROUND OF THE INVENTION

Dating back to the late 1890's Marshall Mattress of Toronto, Canada, developed and patented in 1900 a pocket spring mattress. The pocketed springs in the mattress, which have become more and more popular since the advent of the Marshall Mattress are designed to flex individually of one another and as such have extremely appealing flex properties. Accordingly, many years later, other companies in addition to Marshall make pocket spring mattresses.

Most mattresses, are provided with a stiffened edge recovery region by adding stiffening components which are not part of the inner spring core.

The main sleep area is reinforced by the stiffer edge region. The stiffer edge region does not have anything surrounding it and therefore must rely on its own reinforced characteristics so that it will not break down over time from people sitting on the edge of the mattress.

The standard method of reinforcing the edge area of a mattress is to rely primarily on edge wires in various configurations and add on components, as shown for example in U.S. Pat. No. 4,462,129, issued Jul. 31, 1994 to Brannock and assigned to Simmons U.S.A. In fact, in U.S. Pat. No. 4,462,129, multiple edge wires are provided in the edge region of the mattress.

In as much as conventional edge wires contribute to, but not fully satisfy the intended reinforcement of the edge region of a mattress, these same edge wires also result in some disadvantages in the mattress construction. For example, they produce an edge region which is much stiffer than and uncomfortable relative to the main sleep area in the mattress without necessarily fulfilling full edge recovery. This therefore decreases the constant usable sleep surface area of the mattress.

In addition, hard edge wires eliminate the possibility of folding the mattress which often becomes necessary when trying to get the mattress through a small access area. Furthermore, conventional non-foldable mattresses with edge wires cannot be used for the new leisure style folding beds or for multi-position hospital beds and the like.

SUMMARY OF THE PRESENT INVENTION

The present invention provides a mattress having a main sleep area surrounded by a border or perimeter trim which does not require hard edge wiring for reinforcement of the perimeter trim. As such, the mattress of the present invention does not suffer from the drawbacks noted above with conventional edge wired mattresses.

More particularly, the mattress of the present invention is formed by wire springs contained within pockets of soft material in both the main sleep area and the perimeter trim of the mattress. The wire springs in the sleep area are arranged in honeycomb nested rows. The wire springs in the perimeter trim, which are of a different wire construction and have different flex characteristics from the wire springs in the main sleep area are arranged in side by side rows which are not honeycomb nested. Adjacent wire springs across the perimeter trim are pivotally linked directly to one another both widthwise and lengthwise of the mattress. This reinforces the perimeter trim in a manner such that there is no perceptible difference in flex feel between the perimeter trim and the main sleep area of the mattress.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
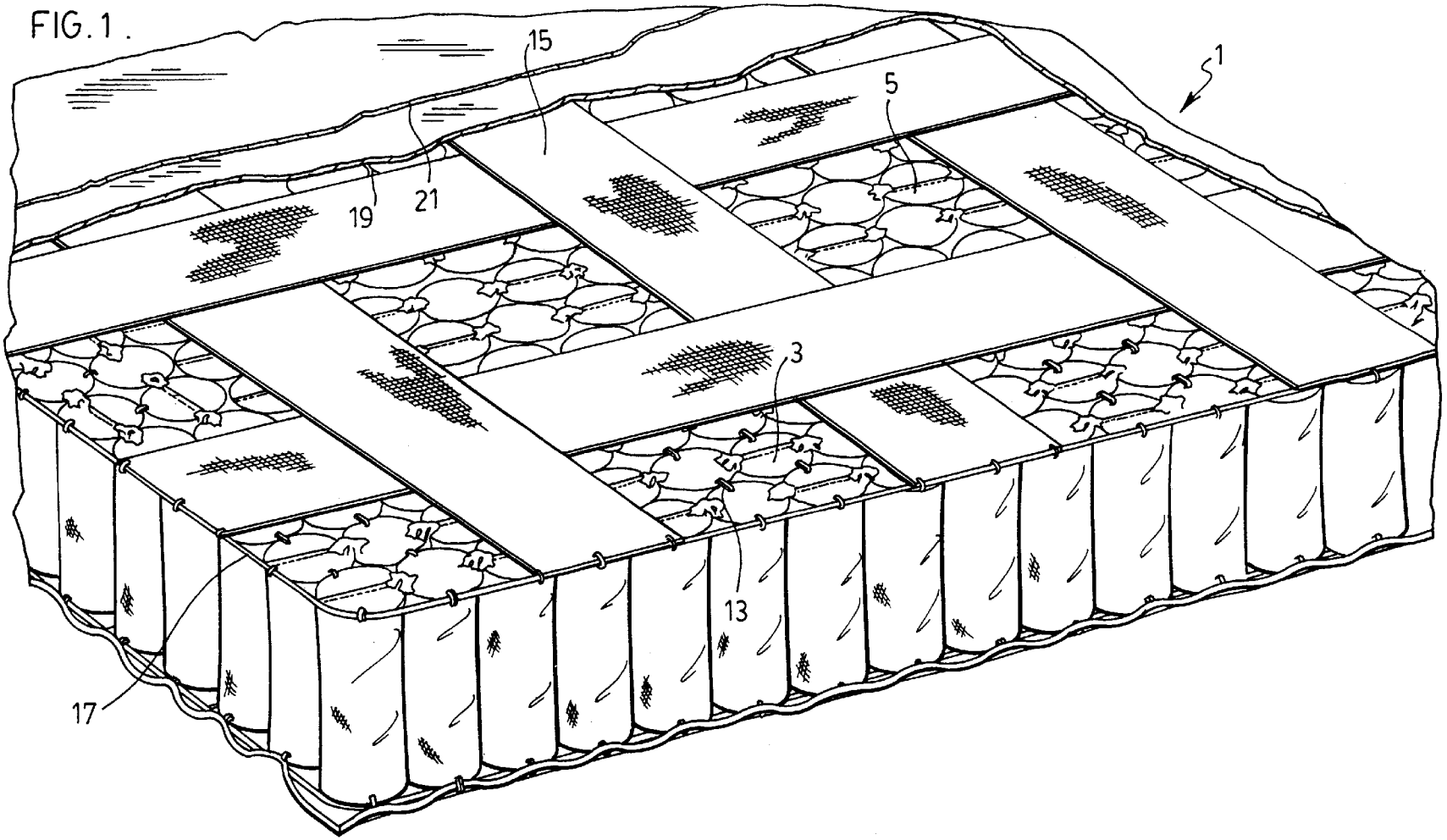
FIG. 1 is a perspective view of a mattress with the external covering removed to show the internal construction according to a preferred embodiment of the present invention.
Figure 4:
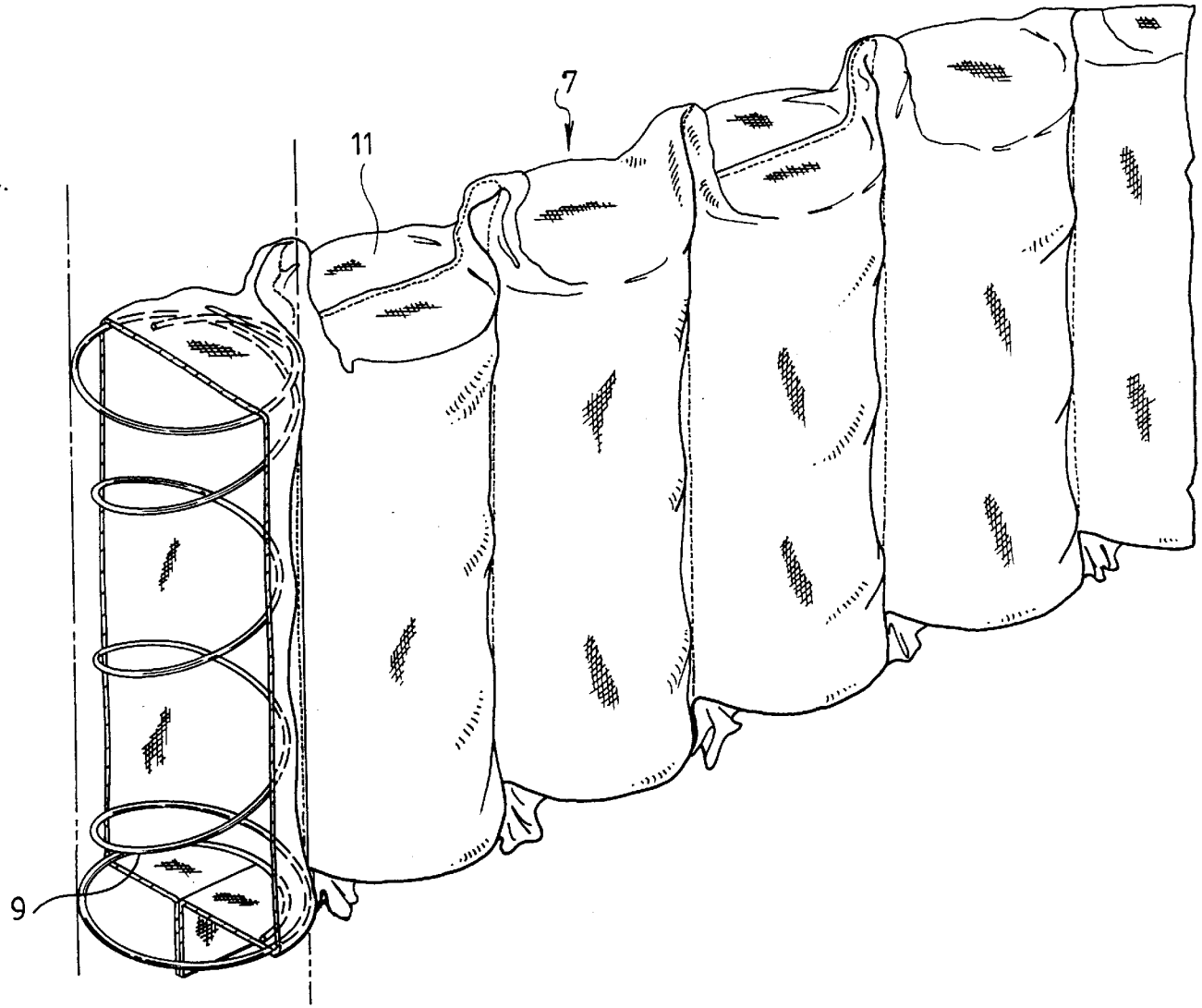
FIG. 4 is a perspective view of a row of pocket coils showing the metal coil spring and soft pocket construction.

FIG. 1 shows a mattress construction generally indicated at 1. This mattress construction is built around a plurality of individually pocketed springs. FIG. 4 of the drawings shows one of the springs 7 comprising a coiled wire 9 contained within a pocket of soft material 11. This material is sewn at its opposite ends to trap the metal coil in a somewhat compressed condition within the pocket.

In the embodiment shown, a long strip of individual pockets are sewn side by side with one another and each one loaded with a metal coil. This arrangement makes it very easy to assemble the overall mattress as will be described later in detail with respect to FIG. 7 of the drawings.

Returning to FIG. 1, mattress 1 is formed with a border or perimeter trim region generally indicated at 3 which surrounds a larger interior region generally indicated at 5. Even though each of these regions is made up of pocketed springs, the border region is somewhat more flex restrained than the interior region of the mattress.

However, the difference in flex between the two regions is essentially imperceptible both in feeling and balance and therefore, the entire mattress is comfortable for sleeping purposes from edge to edge. This is achieved even though the border region is specifically reinforced to accept a concentrated load such as the weight of a person sitting on it without permanent deformation while the larger interior region is specially designed for comfort conditions as required when a person sleeps on the mattress.

Figure 2:
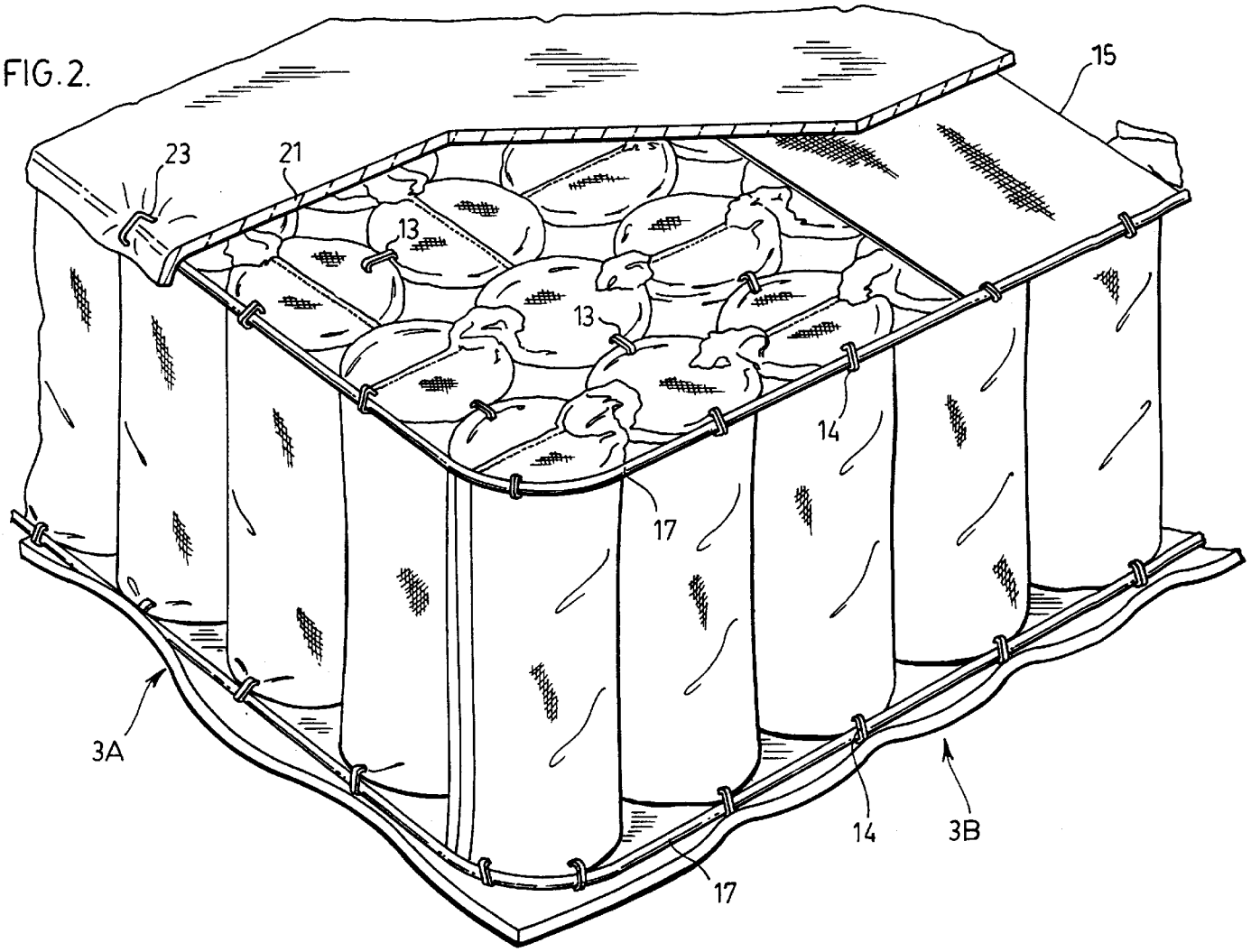
FIG. 2 is an enlargement of the corner region of the mattress construction of FIG. 1.

The border region is reinforced by linking the metal coils of adjacent pocketed springs across the border. More particularly, as best seen in FIGS. 1 and 2 of the drawings side by side pocketed springs in the border 3 are secured by standard upholstering staples 13. These staples are punched through the soft pocket to lock onto the metal coil within each pocketed spring. The staples are attached to the top and bottom turns at opposite ends of adjacent springs sufficiently tightly to prevent the staples from releasing from the springs but not so tightly as to prevent some independent play between adjacent springs, i.e. each staple end is attached in a pivot like manner to its respective metal coil. The staples are a fixed length so that as any one of the springs is compressed so is an adjacent linked spring. However, because of the play allowed between the springs one spring will tend to compress before the next which provides a gradual restraining transition between springs in the border and also between the border and the main sleeping or resting area of the mattress which does not include linking springs. This play also reduces stress on the staples substantially decreasing the likelihood that they might be damaged under load.

Referring specifically to FIG. 2, the border 3 of the mattress is formed by the side edge border 3A and the end edge border 3B. The staples 13 extend across rather than longitudinally of each border edge both lengthwise and widthwise of the mattress achieving a full wrap around balancing with the inner sleep area.

Figure 5:
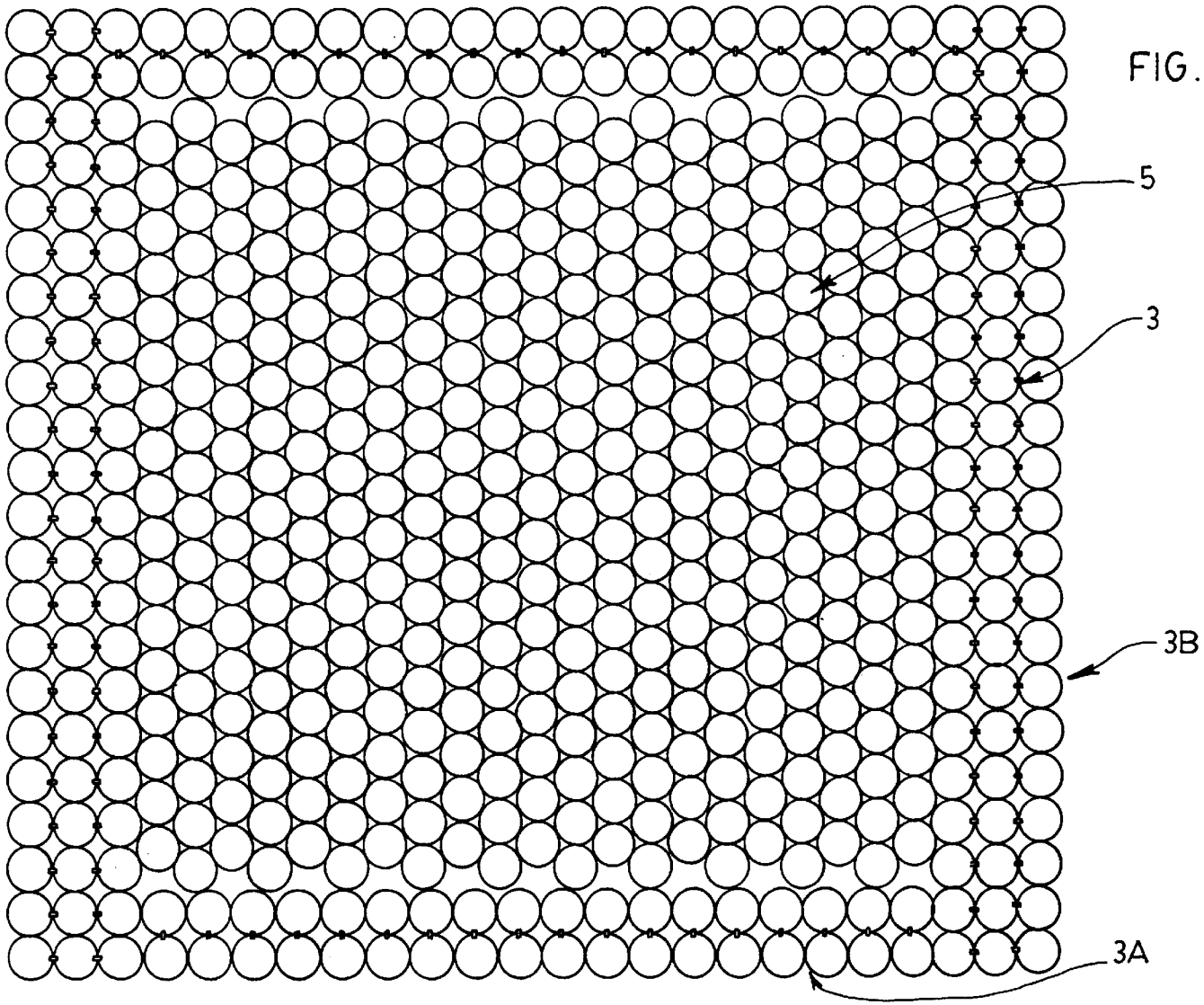
FIG. 5 is a top view of the border and interior resting region formed with pocketed springs according to the mattress construction of FIG. 1.

FIG. 5 of the drawings shows that the pocketed springs in the border 3 of the mattress are arranged as aligned rows, i.e. side by side pocketed springs are centrally aligned with one another. This is to be contrasted to the interior region in which the pocketed springs are arranged in honeycomb nested offset rows.

The side by side spring configuration in the edge border makes it easy to mate the side edge with the end edge regions of the border because each region terminates with a flat end. In addition, it reduces the overall number of springs required in the border.

According to the specific set up shown in FIG. 5, the side edge regions 3A of the mattress border are set up with two side by side linked pocketed springs while the end edge regions of the border 3B are set up with three side by side linked pocketed springs. However the border regions can either have more or fewer side by side springs depending upon the size of the mattress and the amount of reinforcement required. For example, a king sized bed will have more side by side rows in the side edge regions than a twin sized bed which requires fewer rows because of its narrower width.

Figure 4B:
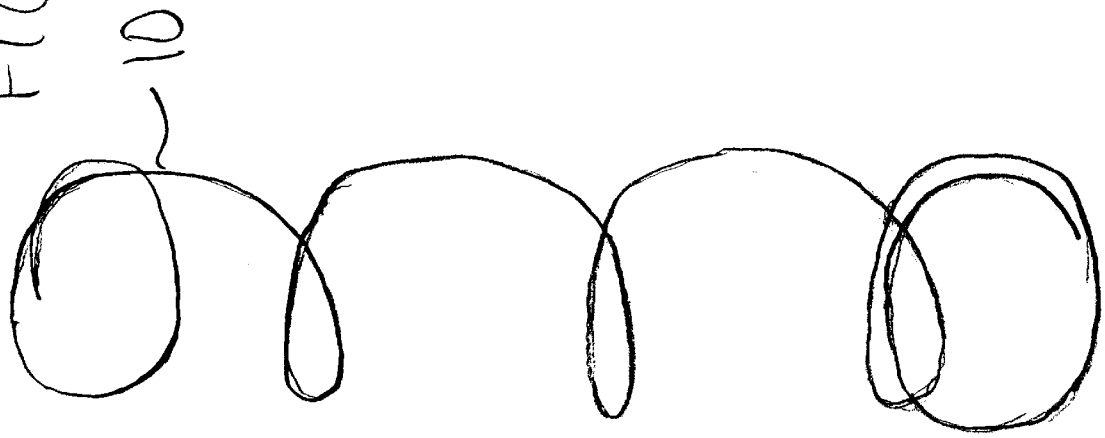
FIG. 4*b* is a perspective view of one of the main sleep area springs removed from its pocket.
Figure 4A:
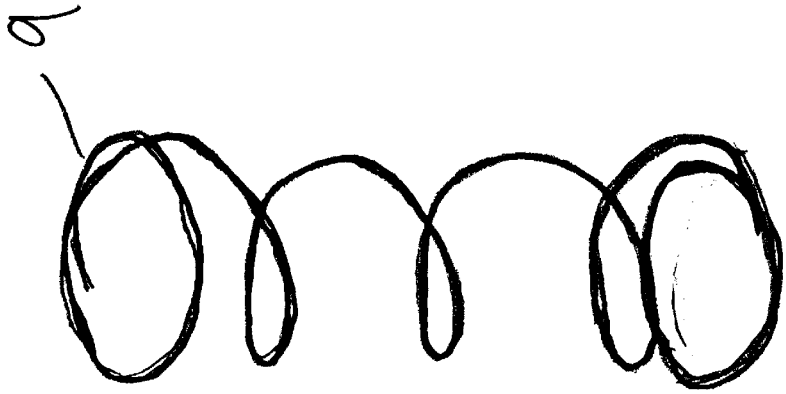
FIG. 4*a* is a perspective view of one of the perimeter trim springs removed from its pocket.

A very interesting feature of the mattress is seen in comparing FIGS. 4A and 4B of the drawings. In particular, FIG. 4A shows wire spring 9 removed from pocket material 11. This is one of the springs used in the edge border whereas FIG. 4B shows a wire spring 10 which is one of the wire springs used in the sleep area. Spring 9 is made of a heavier gauge, e.g. thicker steel than spring 10. Spring 10 on the other hand is made of a higher tensile strength steel than spring 9.

It is to be noted that the border coils and the interior coils are of differing precompressed heights, characteristics of the different wire gauges and tensile strengths given above. However, approximately the same amount of wire is used to make each type of coil and when compressed and finished as a pocketed spring in fabric shorter than the precompressed height, their respective support, comfort and recovery benefits as specifically designed which produce a fully balanced mattress unit. In this fully balanced mattress unit, each spring component marries with and compliments the other as to the intended design of the mattress.

The use of the lighter gauge steel springs in the main sleep area of the mattress reduces the overall weight of the mattress. This makes mattress handling for moving or turning much easier than a conventional heavier mattress.

From a comfort standpoint, the provision of a natural seating edge allows the user to get on to and out of the bed without causing physical discomfort. The edge gives freely when weight is applied and then restores as soon as the weight is released. All of this occurs while the perimeter trim resists permanent decompression which promotes better wear and useful life of the mattress.

In the embodiment shown, the thicker gauge more resistant springs 9 are made from wire rated at 240,000 to 280,000 pounds per square inch while the lighter gauge higher resiliency springs 10 are made from wire rated at 290,000 to 310,000 psi. These springs are more buoyant with better lift loading capacity than the less flexible support springs of the perimeter trim. However, as noted above, the user does not actually feel the difference between the two types of springs which fulfill their individual functions of providing support at the edge and comfort in the main sleep area of the mattress.

In the embodiment of FIGS. 1 and 2, the border is further reinforced by means of metal edge wires 17 at the upper and lower side of the mattress completely around the border. The outermost pocketed springs are secured by staples 14 to the wire edging 17.

These edge wires are not necessary but are only an option in the event that some users want increased stiffness in the border. However, in any event, the edge wires are located to the outside of the springs and do not effect the smooth flex transition from the perimeter trim to the main sleep area.

Also provided to the top and bottom side of the mattress are a plurality of straps 15 which are also stapled to the edge wire. The entire internal construction of the mattress is then covered by covering layers 19 and 21 which are stapled at 23 as seen in FIG. 2 of the drawings to the edge wire.

Figure 3:
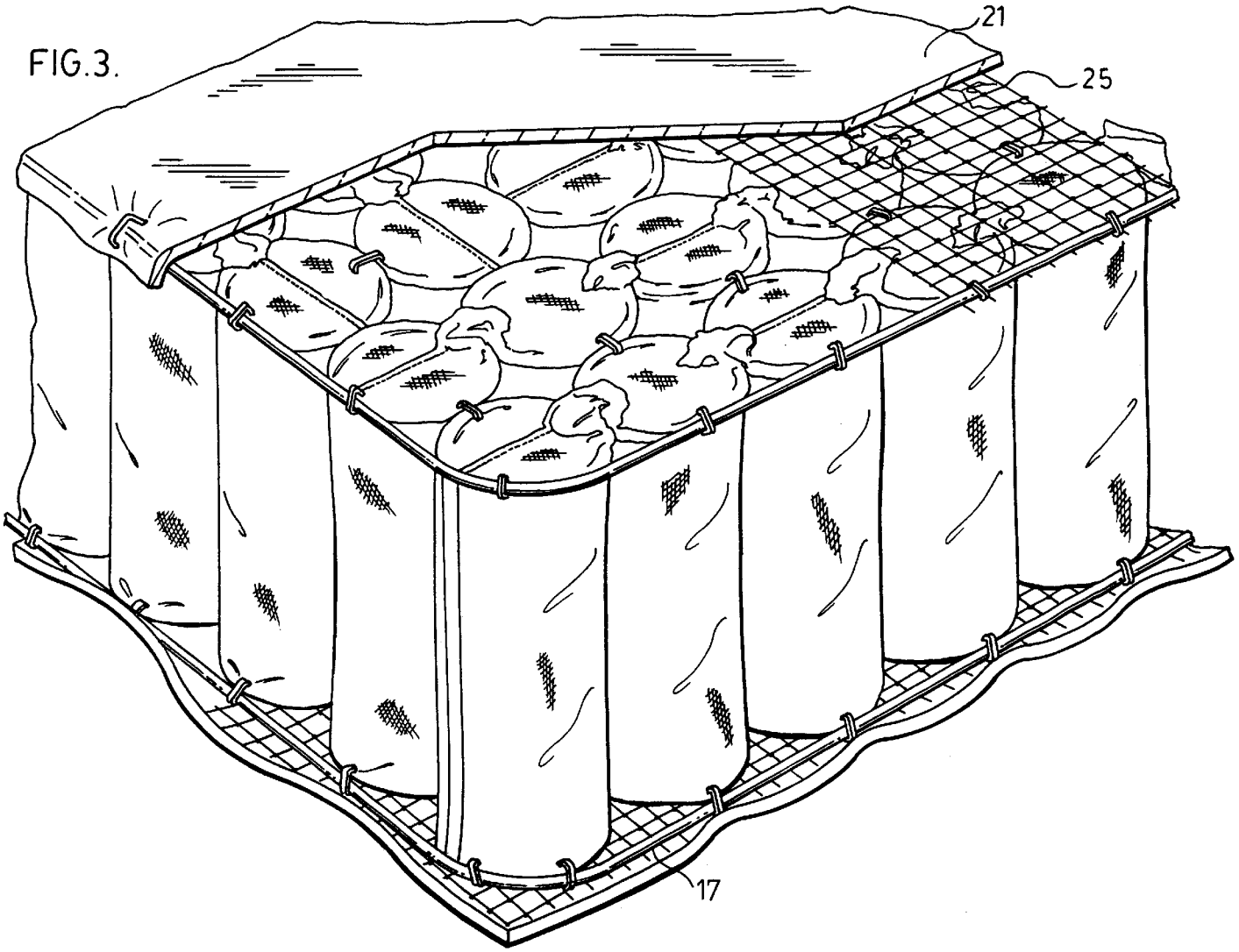
FIG. 3 is a view similar to FIG. 2 with the mattress having a slightly different construction according to another preferred embodiment of the present invention.

FIG. 3 shows a slight modification to the mattress in which straps 15 are replaced by an extruded tear resistant plastic mesh 25 across the complete upper and lower surfaces of the mattress. In all other respects, the mattress shown in FIG. 3 is identical to the mattress shown in FIGS. 1 and 2.

Figure 6:
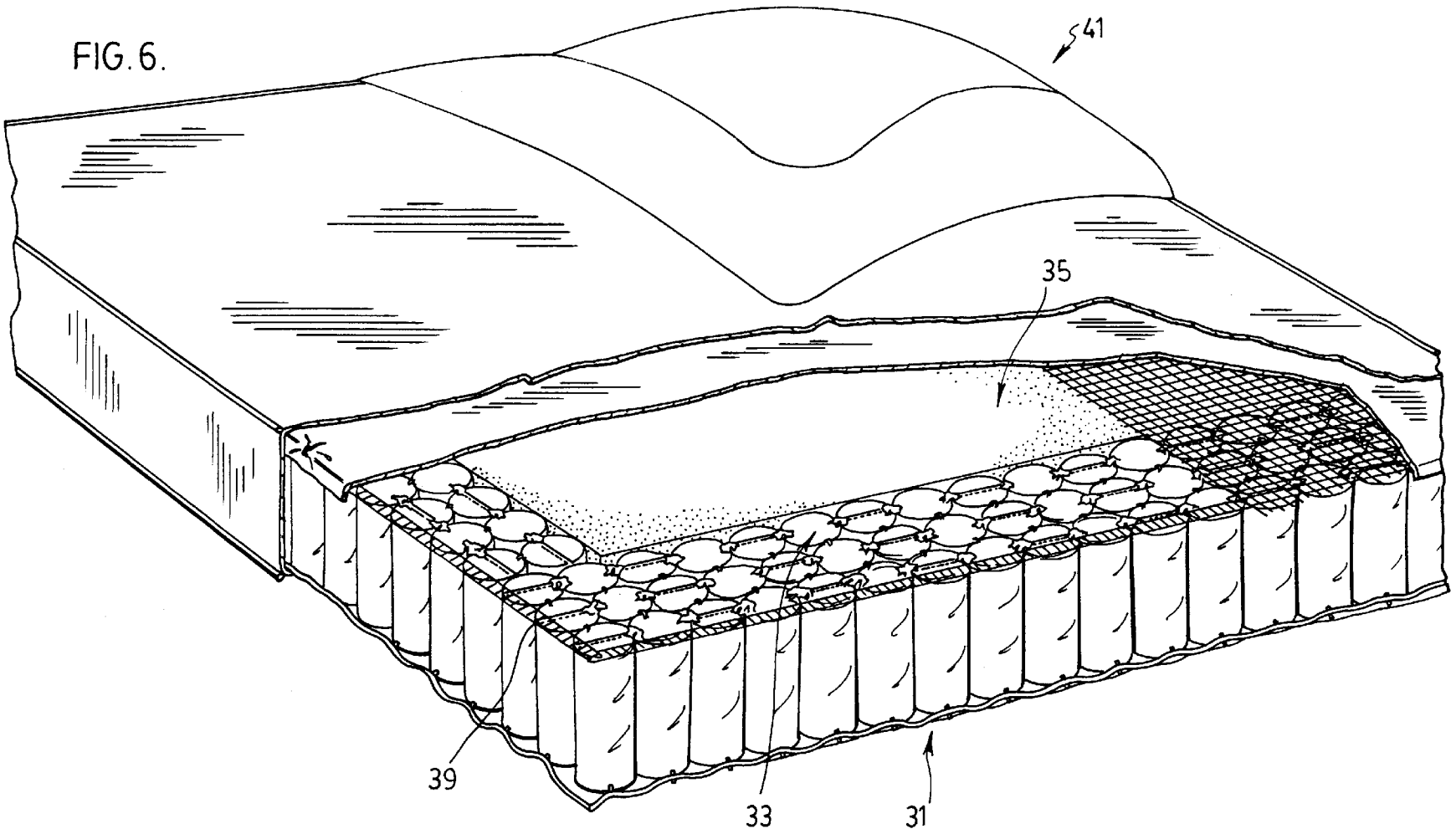
FIG. 6 is a perspective view of a mattress construction according to still a further preferred embodiment of the present invention.

FIG. 6 shows a further mattress generally indicated at 31 again employing a laterally linked pocketed spring edge border generally indicated at 33. However, in his embodiment, the interior region generally indicated at 35 is made from a foam material rather than pocketed springs. This exemplifies the fact that the linked spring edge border can be used around many types of different interior regions.

In addition to the feature of providing a gradual transition from the perimeter trim to the main rest area of the mattress, the use of laterally linked pocketed springs in the border eliminates noticeable intermittent hard and soft areas around the border. Each pocketed spring has a relatively small diameter so that there are no large gaps between reinforcements in the border producing an edge trim which has a very consistent or uniform feeling around the perimeter of the mattress.

Mattress 31 has a further and very unique feature. More specifically, the edge wire shown in the embodiments of FIGS. 1, 2 and 3 has been replaced by a flexible and preferably plastic mesh edging 39 to which the coils in the outermost springs in the border are attached. This edging, which may have the same construction as the spring covering mesh used on the upper and lower sides of the mattress, enables the mattress to be flexed to the extent that it can be bent upon itself in any direction without disrupting the unit as is shown at the mattress corner generally indicated at 41. This feature has substantial benefits when attempting to get a relatively large mattress through a small opening. Unlike a conventional inner spring mattress which has very limited bending capacity, mattress 31 can be bent to almost any configuration for clearing through the opening. The self supporting edge border 33 with its laterally linked springs and mesh overlay attached to the outer edge provides more than adequate reinforcement and around the mattress in any position.

In addition to the mattress being foldable for clearing small springs it is also foldable for use as a hospital mattress where the bed frame bends to different angles, or for use in a leisure bed system where the base frame can be adjusted to a host of different positions with the flexible mattress following the contour of the frame. This is not possible with a conventional hard wired mattress.

Figure 7:
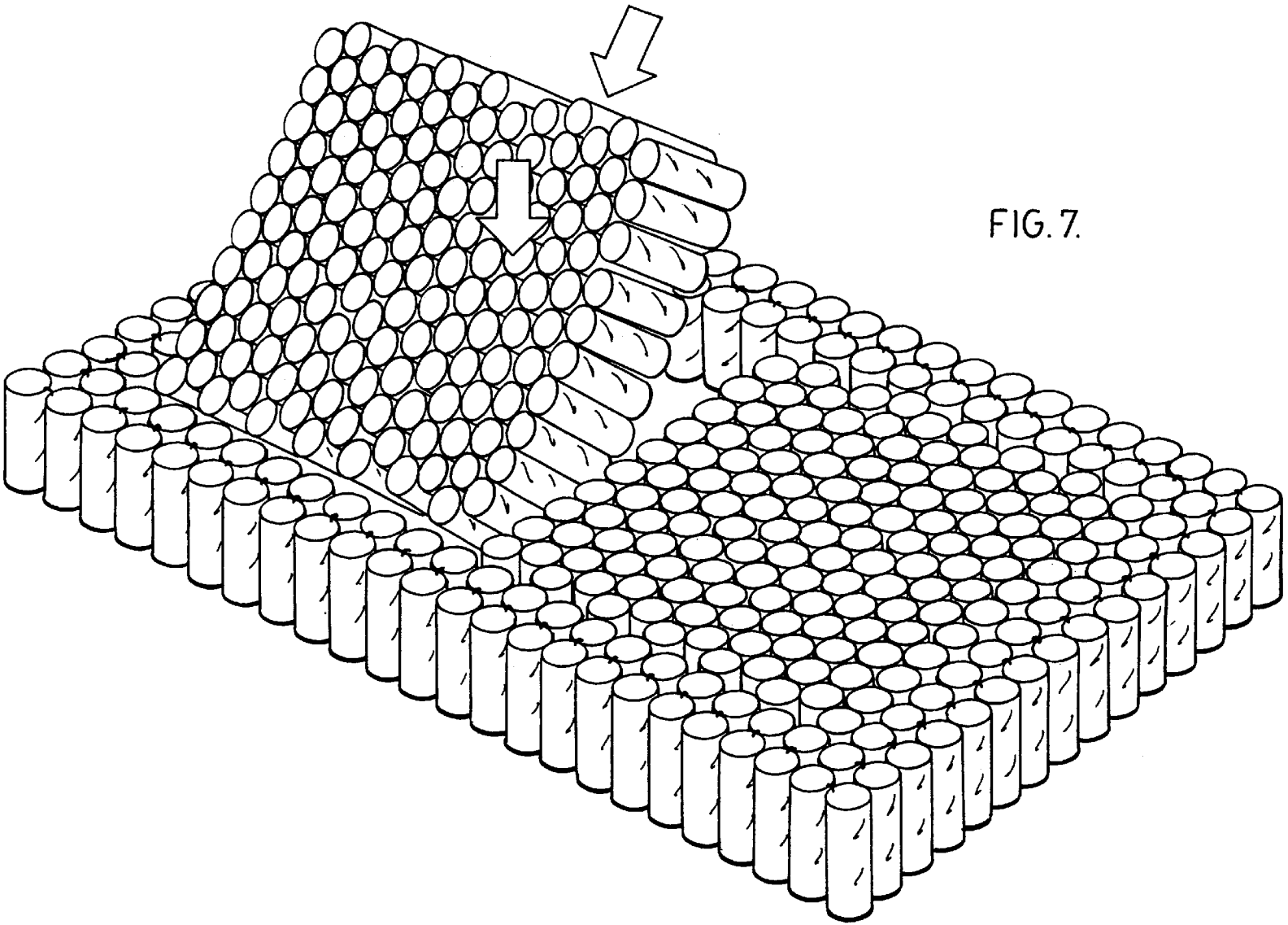
FIG. 7 is a perspective view showing a method of assembling a pocketed spring mattress according to still another preferred embodiment of the present invention.

FIG. 7 of the drawings shows a unique method of assembling a pocketed spring mattress. According to this method, the edge border is first established with the end and side regions of the border being secured to one another and then the interior region pocketed springs are fitted within the border. This is achieved by arranging a plurality of rows of pocketed springs in their honeycombed offset pattern outside of the edge border and then, from one side of the mattress, pushing the arranged rows as a single unit into the edge border. The very nature of the pocketed springs allows them to be compressed to fit in the area defined by the edge border and to then rebound outwardly against the edge border.

The above method is substantially more efficient than attempting to fit the rows of pocketed springs within the border on an individual basis. Further, this method eliminates the difficult procedure of attempting to find sufficient space for the last row or two within the interior region of the mattress.

It is to be noted that the term mattress is not limited to a bed type mattress. As such, the mattress construction of the present invention also includes other structures such as seating cushions and the like.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A mattress comprising a main sleep area surrounded by a perimeter trim, both the main sleep area and the perimeter trim being formed by wire springs contained within individual pockets of soft material, the wire springs in the sleep area being arranged in honeycomb nested offset rows, the wire springs in the perimeter trim being of different wire construction and having different flex characteristics from the wire springs in the main sleep area and being arranged in side by side rows which are not honeycomb nested, adjacent ones of the wire springs across the perimeter trim being pivotally linked directly to one another both widthwise and lengthwise of the mattress to reinforce the perimeter trim in a manner such that there is no substantial feeling of flex difference between the perimeter trim and the main sleep area of the mattress.

2. A mattress as claimed in claim 1, wherein the wire springs in the main sleep area are made of lighter gauge higher tensile strength steel than the wire springs in the perimeter trim.

3. A mattress as claimed in claim 1, which is made without an edge wire and is foldable at any location on the mattress.

4. A mattress as claimed in claim 3, including a tear resistant plastic mesh edging attached outwardly around said perimeter trim.

5. A mattress as claimed in claim 1, having a tear resistant plastic mesh covering the entire mattress to opposite sides thereof.

6. A mattress as claimed in claim 1, made in both a king size and a twin size which is narrower than the king size, the perimeter trim having side border regions which, in the king size, include more rows in the side by side rows than in the twin size mattress.

* * * * *